US010198939B1

(12) United States Patent
Chemisky et al.

(10) Patent No.: US 10,198,939 B1
(45) Date of Patent: Feb. 5, 2019

(54) PROCESS AUTOMATION DEVICE

(71) Applicants: Eric Chemisky, Soultz sous Forets (FR); Sornam Viswanathan Venkateswaran, Karnataka (IN)

(72) Inventors: Eric Chemisky, Soultz sous Forets (FR); Sornam Viswanathan Venkateswaran, Karnataka (IN)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 15/722,159

(22) Filed: Oct. 2, 2017

(51) Int. Cl.
*G08B 29/00* (2006.01)
*G08C 19/02* (2006.01)
*G08C 19/10* (2006.01)

(52) U.S. Cl.
CPC ..... *G08C 19/025* (2013.01); *G08C 19/10* (2013.01)

(58) Field of Classification Search
CPC ..... G08C 19/025; G08C 19/10
USPC ..... 340/506
See application file for complete search history.

(56) References Cited

U.S. PATENT DOCUMENTS 4,238,924 A * 12/1980 Kanegae ..... F02C 9/28 60/39.281
4,782,241 A * 11/1988 Baker ..... H02J 9/062 307/66
8,692,200 B2 * 4/2014 Tao ..... G01J 1/28 250/338.4
9,496,907 B2 * 11/2016 Golly ..... H04B 1/1027
2003/0179125 A1 * 9/2003 Fujita ..... H03M 1/144 341/172
2004/0008079 A1 * 1/2004 Osamura ..... G05F 1/575 327/540
2005/0070177 A1 * 3/2005 Stoll ..... H04L 25/45 439/894
2007/0024365 A1 * 2/2007 Ramaswamy ..... H03F 1/30 330/251
2008/0239766 A1 * 10/2008 Trattler ..... H02M 3/33523 363/21.05
2009/0039973 A1 * 2/2009 Kitayama ..... H03L 1/026 331/36 C
2011/0163822 A1 * 7/2011 Yamanouchi ..... H03F 1/0227 332/145

(Continued)

*Primary Examiner* — Kerri L McNally
*Assistant Examiner* — Thang D Tran
(74) *Attorney, Agent, or Firm* — Lempia Summerfield Katz LLC

(57) ABSTRACT

An analog output stage of a field device employed in process automation is provided. The analog output stage regulates an analog output, for example, a loop current flowing in a two wire current loop, based on an input, for example, a process variable such as temperature, pressure, etc., detected by the field device. The analog output stage includes a regulator module and a switching module. The switching module, via a switching pulse width modulated signal, alternately applies to the regulator module, a first analog value associated with the input detected by the field device and a predefined analog output, and a second analog value associated with the analog output. The regulator module includes an integrator and a differential amplifier. The regulator module generates a differential analog output based on the first analog value and the second analog value and regulates the analog output based on the differential analog output.

12 Claims, 6 Drawing Sheets

(56) References Cited

U.S. PATENT DOCUMENTS

| | | | | |
|---|---|---|---|---|
| 2012/0086474 | A1* | 4/2012 | Idiart | H03M 1/1071 327/70 |
| 2014/0176092 | A1* | 6/2014 | Kolonko | G05F 1/625 323/234 |
| 2015/0061615 | A1* | 3/2015 | Michishita | H02M 3/1588 323/271 |
| 2015/0115832 | A1* | 4/2015 | Conroy | G05F 1/56 315/294 |
| 2015/0263758 | A1* | 9/2015 | Conte | G11C 16/06 365/185.18 |
| 2015/0326115 | A1* | 11/2015 | Chen | H02M 3/156 345/212 |
| 2015/0341208 | A1* | 11/2015 | Wagener | H04L 41/0806 715/735 |
| 2016/0308553 | A1* | 10/2016 | Mitani | H03M 3/48 |
| 2017/0010994 | A1* | 1/2017 | Stoll | G06F 13/387 |
| 2017/0135186 | A1* | 5/2017 | O'Neil | H05B 37/0272 |
| 2017/0153161 | A1* | 6/2017 | Yomoyama | G01L 23/10 |
| 2017/0160708 | A1* | 6/2017 | Bracker | G05B 17/02 |
| 2018/0026636 | A1* | 1/2018 | Birkner | H03K 19/017581 |
| 2018/0225486 | A1* | 8/2018 | Teruyama | G06K 19/07 |

* cited by examiner (PRIOR ART)

PROCESS AUTOMATION DEVICE

TECHNICAL FIELD

The present disclosure relates to an analog output stage of a process automation device employed in a process automation system. More particularly, the present disclosure relates to an analog output stage of a process automation device having a standardized 4-20 mA interface for transmitting process variables sensed by the process automation device.

BACKGROUND

Process industry plants, for example, chemical, petrochemical, pharmaceutical, food and other products manufacturing industries, may include, at a field level, locally distributed, decentralized process automation devices, that is, field devices. Such field devices have predefined functions within the plant's process automation system and are involved in an exchange of information associated with the process, the plant, and/or other field devices, with components of a monitoring and control system, and also amongst one another. The field devices may sense information about real world signals such as pressure, flow, level, and temperature. Conventionally, in a process automation system, the transfer of process data from the field devices to the monitoring and control system devices such as programmable logic controllers (PLCs), is carried out in the form of analog current values ranging between about 4 milliamps (mA) and about 20 mA.

FIG. 1 illustrates a conventional equivalent circuit of a two-wire current loop 100 in a process automation system. The two-wire current loop 100 communicatively couples a field device 101 with a receiver 102 via a cable. The field device 101 is, for example, a pressure transmitter in communication with a sensor (not shown) sensing pressure values, in the process automation system. The field device 101 is connected to a power source 103. In a current loop 100, cables may have a varying range of length and may be over 1 km long, due to which, voltage at device terminals 101*a* and 101*b* may drop to about 10.5 volts (V) or increase to about 42V based on the length of cable therebetween. Therefore, the power source 103 is a DC power source, for example, including one or more battery sources of 24V or 12V, powering the field device 101, and/or the receiver 102. The receiver 102 is, for example, a programmable logic controller (PLC). The field device 101 converts these pressure values that are essentially the real world signals, into the control signals necessary to regulate the flow of current in the two-wire current loop 100. The loop current is adjusted by the field device 101 to be proportional to the actual measured pressure input. The field device 101 may use a 4 mA output to represent a calibrated zero input, and a 20 mA output to represent a calibrated full-scale input signal. The field device 101 draws its operating power from the loop current flowing therein. This field device 101 modifies the loop current flowing over a cable such that the receiver 102, that is, the PLC 102, receives and measures this modified loop current in order to sense the measurement recorded by the field device 101. The PLC 102 is further connected to monitoring and control system (not shown) which in turn is connected to a host computer in the process automation system.

FIG. 2 illustrates a conventional current output stage 200 of the field device 101 illustrated in FIG. 1. The field device 101 is connected to the current loop 100 via terminals 101*a* and 101*b*. The current output stage 200 includes a regulator module 201 including an operational amplifier (OPAMP) configured as a differential amplifier. The regulator module 201 compares two inputs namely, a first input, for example, a set point voltage 203, associated with a sensed value of a real world signal, such as pressure, obtained from a sensor sensing the real world signal and communicating with the field device 101 and a second input, for example, a feedback voltage representing the loop current flowing in the current loop. The input values to be compared are obtained using a resistor divider module 202 including resistors R1 and R2, and a sense resistor Rs. However, the resistors R1, R2, and Rs in the conventional current output section 200 directly affect temperature characteristics thereby affecting accuracy of measurement, and long-term stability behavior of the current output. In some applications, military grade components may be employed to preclude affects associated with temperature characteristics, however, these lead to a drastic increase in the costs associated therewith. The effect of temperature characteristics may be reduced by calibrating the behavior of the resistive components at a manufacturing stage. However, this calibration over temperature is expensive. In addition, the long-term stability of such resistive components is not specified by the manufacturers and suppliers, as this requires a series of tests, thereby leading to increase in the costs. Moreover, the long-term stability of a device cannot be designed using a worst case limitation as the long term stability behavior is designed based on real time application conditions. To increase long-term stability, analog signals may be converted to digital signals before being transmitted to the PLCs, however, this involves additional circuitry leading to higher power consumption. The two-wire current loops may be power limited and required to be efficient in power conditioning, in order to provide safe operation in hazardous environments having a large number of variants. The power may be limited in a range of about 10 milliwatts (mW) to about 40 mW.

Therefore, it is an object of the present disclosure to provide a field device of the aforementioned kind having an analog output stage that regulates an analog output based on an input detected by the field device, without compromising on cost, temperature based measurement accuracy, and long-term stability of the field device.

SUMMARY

This summary is provided to introduce a selection of concepts in a simplified form that are further disclosed in the detailed description. This summary is not intended to identify key or essential concepts of the claimed subject matter, nor is it intended for determining the scope of the claimed subject matter.

The present disclosure achieves the aforementioned object by providing an analog output stage of a field device employed in process automation, for regulating an analog output based on an input detected by the field device. As used herein, "analog output stage" refers to a circuitry of the field device that regulates an analog value in correspondence with the input, that is, a process variable, detected by the field device. For example, the analog output stage includes a current output stage where the analog output is a loop current flowing in a two wire or a four wire current loop, or a voltage output stage where the analog output is a voltage. Also, used herein, "process variable" refers to a real world signal such as pressure, temperature, etc., that is sensed by a sensor such as a pressure transducer or a temperature sensor. In one aspect, the sensor is in communication with the field device. In another aspect, the sensor is in-built in the field device. The sensed signal is converted into an analog signal such as a voltage level which may be converted into a digital signal using an analog to digital converter. The field device includes, for example, a pressure transmitter, a flow meter, a level sensor, a temperature sensor, a gas sensor, etc., communicatively coupled to a receiver, that is, a programmable logic controller (PLC), in a process automation system, for example, via a two wire current loop or a four wire current loop.

The analog output stage includes a regulator module communicatively coupled to a switching module. The regulator module controls the analog output. In accordance with one aspect, the regulator module includes an integrator and a differential amplifier. The regulator module includes an operational amplifier (OPAMP) as the differential amplifier. The switching module alternately applies to the regulator module, a first analog value associated with the input detected by the field device, and a second analog value associated with the analog output. As used herein, "first analog value" and "second analog value" refer to inputs provided to the differential amplifier of the regulator module. For example, the first analog value is a voltage corresponding to the input and a predefined analog output corresponding to the input whereas the second analog value is a voltage corresponding to the analog output such as a loop current flowing in the current loop which is measured over a resistor. The integrator of the regulator module includes a resistor and a feedback capacitor, wherein the resistor and the feedback capacitor integrate the first analog value and/or the second analog value.

A processor of the field device receives the process variable from the sensor and generates a digital signal in form of a reference pulse width modulated signal. In one aspect, the reference pulse width modulated signal is at fixed frequency but with a duty cycle that varies according to the process variable. For example, for a low pressure or a low temperature, the reference pulse width modulated signal having short pulse trains for a time interval 't' are generated. Similarly, for higher values of the process variables, broader pulse trains are generated in the time interval 't'. The reference pulse width modulated signal sets the first analog value. The reference pulse width modulated signal is thus, generated based on the input detected by the field device and a predefined analog output that corresponds to the input detected by the field device. As used herein, "predefined analog output" refers to a desired set analog value that is to be maintained for a particular input value. For example, a range of the process variable being sensed is mapped to a range of the desired analog output, such as, the expected loop current ranging between about 0 mA to about 25 mA. The processor also generates a switching pulse width modulated signal. The switching pulse width modulated signal drives the switching module.

In accordance with one aspect, the first analog value includes a coarse component set by a first reference pulse width modulated signal and a fine component set by a second reference pulse width modulated signal. The processor generates the first and second reference pulse width modulated signals. In accordance with this aspect, the switching module alternately applies to the regulator module, the coarse component, the fine component, and the second analog value. In accordance with one aspect, the fine component is a function of the coarse component, for example, a ratio of the coarse component to the fine component is 2:1. In accordance with another aspect, the analog output stage includes processing modules, for example, a filter, an amplifier, etc. In accordance with this aspect, the first analog value and/or the second analog value are processed by one or more of the processing modules, before being applied to the regulator module.

In accordance with yet another aspect of the present disclosure, a method of regulating an analog output of a field device employed in process automation based on an input detected by the field device is provided. The method provides the field device having an analog output stage communicatively coupled to a processor of the field device. The analog output stage includes a regulator module and a switching module, especially as disclosed above. The processor obtains the input detected by the field device, such as, a process variable. The processor generates a reference pulse width modulated signal that outputs a first analog value based on the input detected by the field device and a predefined analog output that corresponds to the input detected by the field device. The processor detects the analog output, that is, the existing analog output. The switching module alternately provides to the regulator module the first analog value and a second analog value. wherein the switching module is driven by a switching pulse width modulated signal generated by the processor, and wherein the second analog value is associated with the detected analog output. In one aspect, processing modules such as a filter and an amplifier of the analog output stage process the first analog vale and/or the second analog value before being applied to the regulator module. The regulator module generates a differential analog output based on the first analog value and the second analog value. In one aspect, the regulator module integrates the first analog value and/or the second analog value. The regulator module regulates the analog output of the field device based on the differential analog output.

The above-mentioned and other features of the disclosure will now be addressed with reference to the accompanying drawings of the present disclosure. The illustrated embodiments are intended to illustrate, but not limit the disclosure.

BRIEF DESCRIPTION OF THE DRAWINGS

The present disclosure is further described hereinafter with reference to illustrated embodiments shown in the accompanying drawings, in which.

Figure 1:
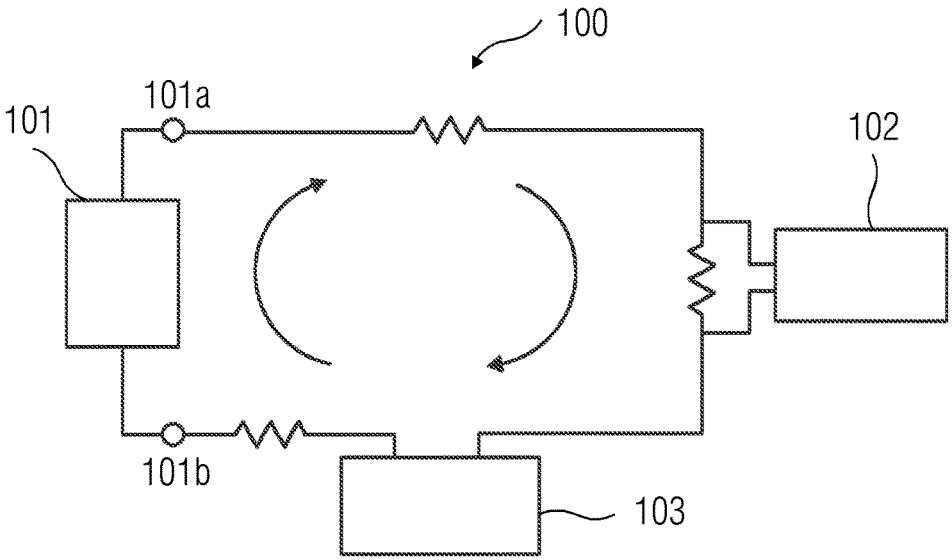
FIG. 1 illustrates a conventional equivalent circuit of a two-wire current loop in a process automation system.

The foregoing summary, as well as the following detailed description, is better understood when read in conjunction with the appended drawings. For the purpose of illustrating the disclosure, exemplary constructions are shown in the drawings. However, the disclosure is not limited to the specific methods and structures disclosed herein. The description of a method act or a structure referenced by a numeral in a drawing is applicable to the description of that method act or structure shown by that same numeral in any subsequent drawing herein.

DETAILED DESCRIPTION

Figure 3:
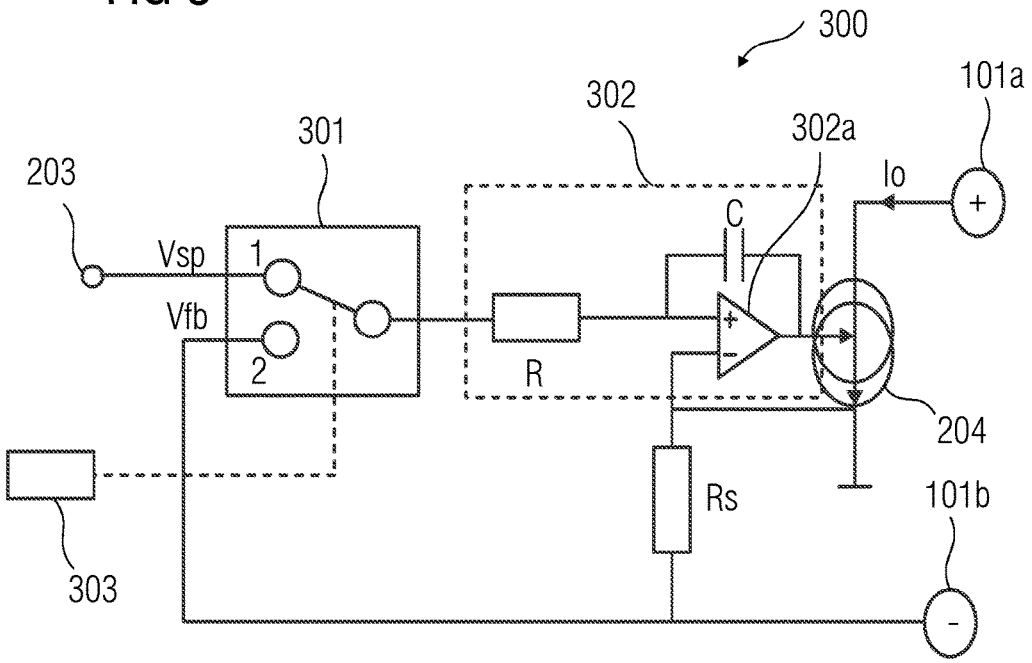
FIG. 3 illustrates a circuit diagram of a current output stage of a field device for process automation according to one aspect of an analog output stage.

FIG. 3 illustrates a circuit diagram of a current output stage 300 of a field device 101 for process automation according to one aspect of an analog output stage. The current output stage 300, at its output, regulates an analog output, that is, a loop current Io, flowing in a current loop 100 shown in FIG. 1. The loop current Io is a function of a process variable such as an analog real world signal including pressure, temperature, etc., that the field device 101 senses and measures via a sensor, transducer, etc. The loop current Io lies in a range of about 4 mA to about 20 mA. However, for designing of various components of the current output stage 300, a range of 0 mA to 25 mA is considered. For example, a loop current Io below 4 mA, that is, between 0 mA and 3.6 mA, or above 20 mA, that is, between 22.8 mA and 25 mA, may indicate malfunctioning of the field device 101, e.g. malfunctioning of one or more components in the current output stage 300. The current output stage 300 includes a regulator module 302 communicatively coupled to a switching module 301. The regulator module 302 is communicatively coupled to the terminals 101*a* and 101*b* of the field device 101, with which the field device 101 communicates with the current loop 100. The terminal 101*b* is a negative terminal and the terminal 101*a* is a positive terminal. The regulator module 302 is connected to the terminals 101*a* and 101*b* via a current regulation circuitry 204 that converts a differential voltage output of the regulator module 302 into a corresponding loop current Io. The regulator module 302 includes an operational amplifier (OPAMP) 302*a* which is configured as a differential amplifier 302*a* regulating input voltages applied to its input terminals. That is, the OPAMP 302*a* acts as a nullor that drives its differential output voltage to zero. The regulator module 302 also an integrator including a resistor R and a feedback capacitor C. The resistor R and the feedback capacitor C integrate, that is, smoothen, the output of the switching module 301 which is applied to the input of the OPAMP 302*a*. The temperature coefficient and long-term stability of the components R and C have a near zero effect on the stability of the current output stage 300, thereby, eliminating need of employing costly components for improving an overall stability. Moreover, the capacitor C may be selected from capacitors available at a lower price and higher long-term stability and temperature characteristics.

Figure 2:
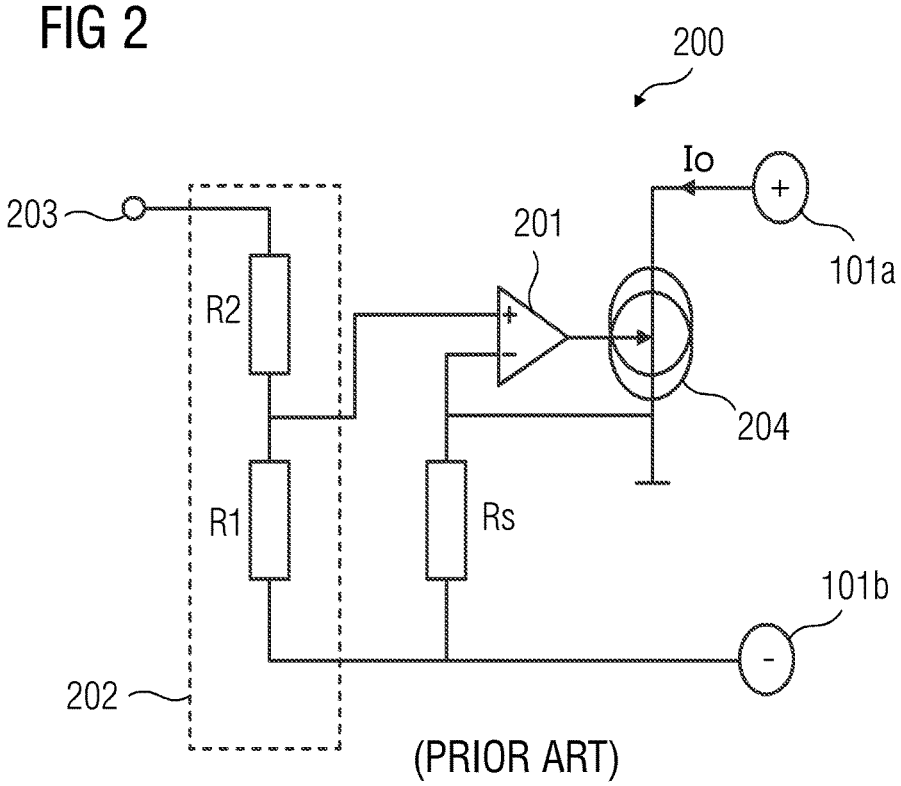
(PRIOR ART) FIG 2
FIG. 2 illustrates a conventional current output stage of the field device illustrated in FIG. 1.

The switching module 301 is, for example, a single pole double throw switch alternately applying to the regulator module 302, a first analog value, that is, a set point voltage Vsp associated with the input detected by the field device 101, and a second analog value, that is, a feedback voltage Vfb associated with the loop current Io. The voltage Vfb is measured based on the loop current Io flowing over a sense resistor Rs. A switching pulse width modulated signal drives the switching module 301. A processor 303 of the field device 101 generates the switching pulse width modulated signal. In order to design components of the current output stage 300, for example, a duty cycle of the switching pulse width modulated signal, the loop current Io to be generated by the current output stage 300 is considered to be maximum, that is, 25 mA. Assuming, the sense resistor 'Rs' is of 30 Ohms, the voltage Vfb, at a switching position 2 of the switching module 301, is equal to product of the loop current Io and the sense resistor Rs=Io*Rs=25 mA*30 Ohms=0.75V. As disclosed in the detailed description of FIG. 2, the switching module 301 replaces the resistor divider module 202 and therefore, the duty cycle of the switching pulse width modulated signal is computed based on a ratio of the resistors R1 and R2 of the resistor divider 202. That is, a ratio of the set point voltage Vsp applied at a switching position 1 of the switching module 301 and the feedback voltage Vfb is equal to the ratio of the resistors R1 and R2. By using this computation, Vsp can be calculated as 2.048V for Vfb of 0.75V at Io=25 mA, for example, based on commonly available resistor values of R2=100 kilo Ohm and R1=36.5 kilo Ohm. The set point voltage Vsp is applied at terminal 203 of the current output stage 300. Thus, the loop current Io ranging from 0 mA to 25 mA is mapped to a set point voltage Vsp of 0V to 2.048V. This Vsp is set by a reference pulse width modulated signal generated by the processor 303 based on the input detected by the field device 101 and a predefined loop current Io to be generated in accordance with the input detected by the field device 101, using the mapping range disclosed above. For example, consider a process variable input having a sensing range of 0 degrees Celsius to 100 degrees Celsius. Assuming that at a particular instant the process variable input is about 64 degrees Celsius which maps to a predefined loop current Io being as 16 mA. Therefore, Vsp would be set at a value of 1.311V based on the 0V-2.048V range of Vsp mapped to 0 mA to 25 mA operating range of Io. The duty cycle of the switching pulse width modulated signal is calculated as ratio of Vfb to Vsp=36%. Therefore, for maximum output current Io=25 mA, the processor 303 generates a switching pulse width modulated signal such that the feedback voltage Vfb is applied to the regulator module 302 for 64% of a time interval 't' and the set point voltage Vsp is applied for 36% of the time interval 't'. Thus, lesser the loop current Io, lesser is the set point voltage Vsp, and higher is the duty cycle percentage, such that Vsp will be applied for a longer duration compared to Vfb.

Figure 4:
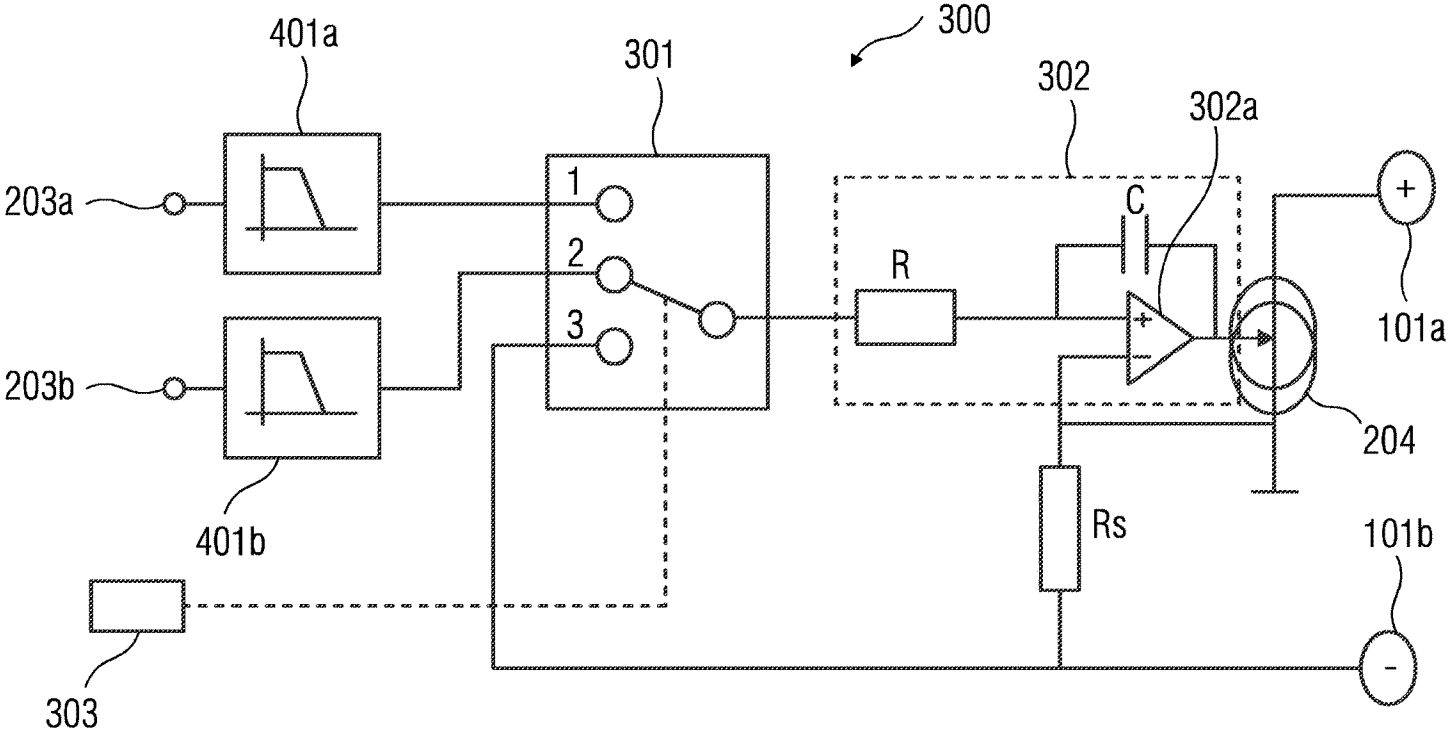
FIG. 4 illustrates a circuit diagram of the current output stage of the field device shown in FIG. 3, according to another aspect of the analog output stage.

FIG. 4 illustrates a circuit diagram of the current output stage 300 of the field device 101 shown in FIG. 3, according to another aspect of the analog output stage. As shown in FIG. 4, the first analog value, that is, Vsp is split into a coarse component 203*a* and a fine component 203*b*. A first reference pulse width modulated signal generated by the processor 303 sets the coarse component 203*a* and a second reference pulse width modulated signal generated by the processor 303 sets the fine component 203*b*. The fine component 203*b* being a function of the coarse component 203*a*. The coarse component 203*a* and the fine component 203*b* are passed through low pass filters 401*a* and 401*b* respectively. The low pass filters 401*a* and 401*b* average or smooth the coarse component 203*a* and the fine component 203*b*. A reaction time of the current output stage 300 required to generate and regulate the loop current Io, may be dependent on a clocking frequency of the processor 303, a frequency of the reference pulse width modulated signal used to generate Vsp, and a resolution of the reference pulse width modulated signal. The clocking frequency of the processor 303 affects power consumption of the current output stage 300 and therefore, cannot be increased. Similarly, the frequency of the reference pulse width modulated signal cannot be arbitrarily decreased because this affects the analog signal, that is, Vsp, being generated. Therefore, by dividing the Vsp into a coarse component 203*a* and a fine component 203*b* and by filtering each of these components 203*a* and 203*b*, a resolution of the reference pulse width modulated signal is increased without compromising on the reaction time of the current output stage 300 required to regulate the output current Io.

The switching module 301 alternately applies to the regulator module 302, the coarse component 203*a*, the fine component 203*b*, and the feedback voltage Vfb. For example, for a loop current of Io=25 mA, the switching pulse width modulated signal driving the switching module 301 is set at a duty cycle such that Vsp is applied to the regulator module 302 for 64% of a time interval 't' and the coarse component 203*a* and the fine component 203*b* together are applied for 36% of the time interval 't'. Out of the 36% time interval, the coarse component 203*a* is applied for a longer duration compared to the fine component 203*b*. For example, a ratio of 2:1 is selected for the coarse component 203*a* to the fine component 203*b*. In this example, the coarse component 203*a* represents upper bits of the reference pulse width modulated signal and the fine component 203*b* represents the lower bits of the reference pulse width modulated signal.

Figure 5:
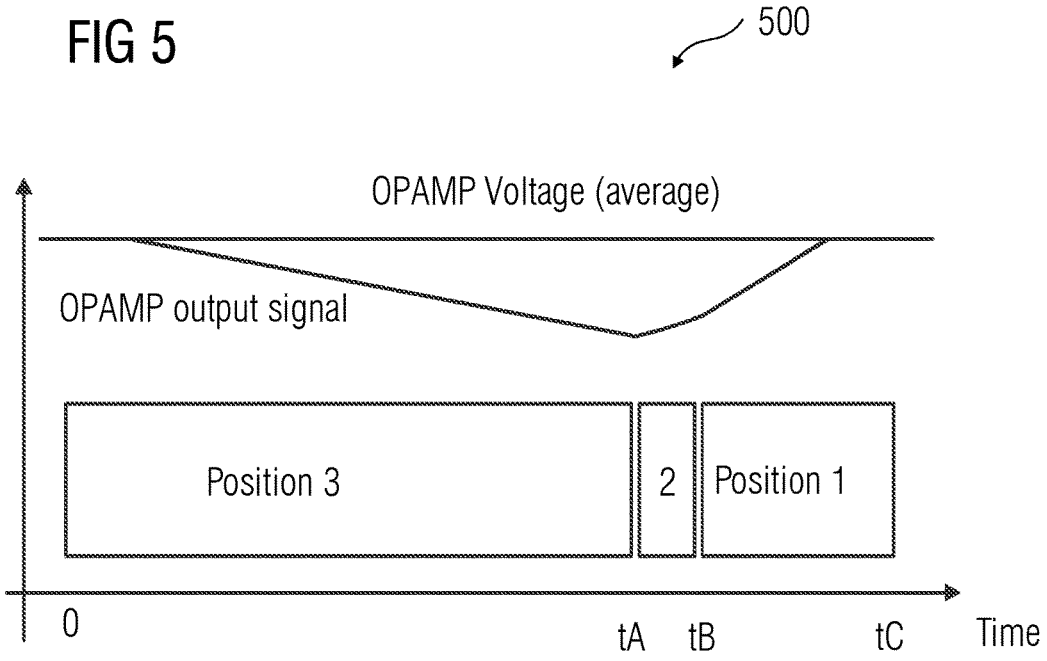
FIG. 5 illustrates a graphical representation of an output of the regulator module based on a switching cycle of the switching module of the current output stage illustrated in FIG. 4.

FIG. 5 illustrates a graphical representation 500 of an output of the regulator module 302 based on a switching cycle of the switching module 301 of the current output stage 300 illustrated in FIG. 4. The switching module 301 switches from a position 3 to a position 2 and then to a position 1, that is, applies the feedback voltage Vfb followed by the fine component 203*b* and then the coarse component 203*a*. The set point voltage Vsp charges the feedback capacitor C of the regulator module 302, as shown in FIG. 5 from position 2 onwards, and the feedback voltage Vfb discharges the feedback capacitor C, as shown in FIG. 5 during position 3. Thus, an average output at the regulator module 302, represents a sum of all the input signals applied thereto.

Figure 6:
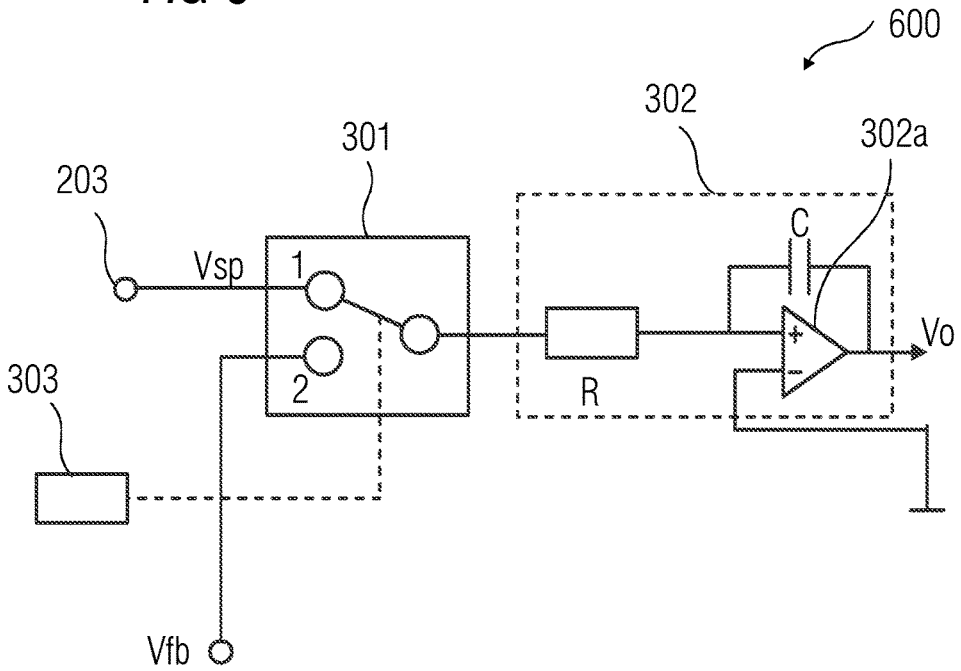
FIG. 6 illustrates a circuit diagram of a voltage output stage of a field device, according to another aspect of the analog output stage.

FIG. 6 illustrates a circuit diagram of a voltage output stage 600 of a field device 101, according to another aspect of the analog output stage. In this aspect, the analog output stage is configured as a voltage output stage 600 including the regulator module 302 and the switching module 301 especially as disclosed in the detailed description above. The switching module 301 alternately applies to the regulator module 302 the set point voltage Vsp and the feedback voltage Vfb. Vsp is a set point voltage predefined based on an input detected by the field device 101. The regulator module 302 integrates the voltages Vsp and Vfb. The regulator module 302 generates a differential output voltage Vo which may be further fed to a voltage transmission component in a process automation system.

Figure 7:
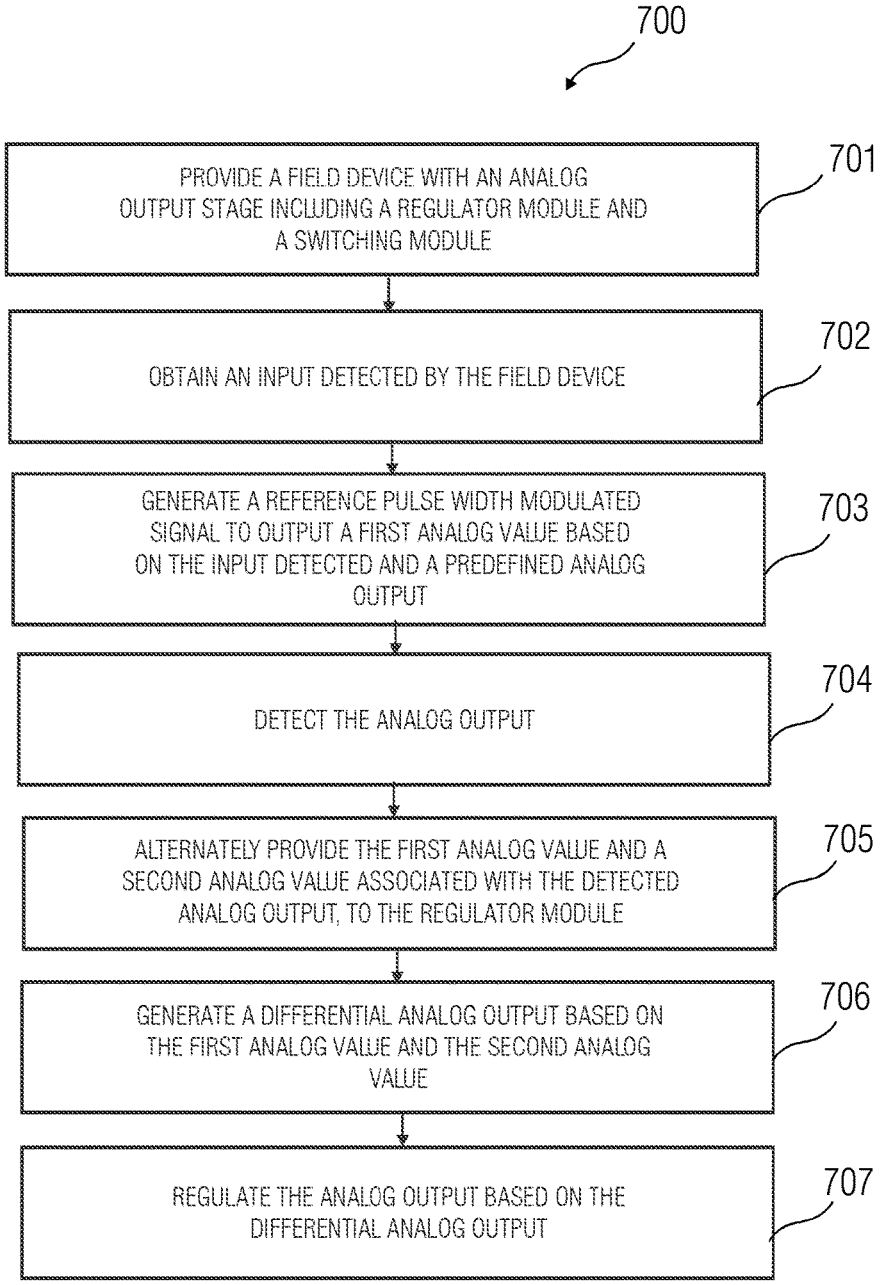
FIG. 7 illustrates a process flowchart of an exemplary method of regulating an analog output of a field device employed in process automation based on an input detected by the field device, in accordance with the aspects of the analog output stage illustrated in the FIGS. 3-5.

FIG. 7 illustrates a process flowchart 700 of an exemplary method of regulating an analog output of a field device 101 shown in FIG. 1, employed in process automation based on an input detected by the field device 101, in accordance with the aspects of the analog output stage such as the current output stage 300 illustrated in the FIGS. 3-4 and/or the voltage output stage 600 illustrated in FIG. 6. At act 701, the method provides the field device 101 having an analog output stage 300, 600 communicatively coupled to a processor 303 of the field device 101. The analog output stage 300, 600 includes a regulator module 302 and a switching module 301 especially as disclosed above in the detailed description of FIGS. 3, 4, 6. At act 702, the processor 303 obtains the input detected by the field device 101, such as, a process variable. At act 703, the processor 303 generates a reference pulse width modulated signal that outputs a first analog value, that is, Vsp, based on the input detected by the field device 101 and a predefined analog output that corresponds to the input detected by the field device 101. At act 704, the processor 303 detects the analog output, that is, the existing analog output, such as, the loop current Io shown in FIGS. 3-4 or a feedback voltage Vfb shown in FIG. 6. At act 705, the switching module 301 alternately provides to the regulator module 302, the first analog value Vsp, and a second analog value Vfb associated with the detected analog output. At act 706, the regulator module 302 generates a differential analog output based on the first analog value Vsp and the second analog value Vfb. At act 707, the regulator module 302 regulates the analog output of the field device 101 based on the differential analog output, for example using the current regulation circuitry 204 of a current output stage 300 in a current loop transmission or by summing the differential analog output with the existing analog output voltage in a voltage transmission component of a process automation system.

It is to be understood that the elements and features recited in the appended claims may be combined in different ways to produce new claims that likewise fall within the scope of the present disclosure. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present disclosure has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. An analog output stage of a field device employed in process automation, for regulating an analog output based on an input detected by the field device, the analog output stage comprising:

a regulator module comprising an operational amplifier and an integrator having a resistor and capacitor, wherein the regulator module is configured to control the analog output; and a switching module communicatively coupled to the regulator module, the switching module configured to alternately apply to the regulator module, a first analog value associated with the input detected by the field device and a second analog value associated with the analog output, wherein the integrator of the regulator module is configured to smoothen an output from the switching module, which is applied to an input of the operational amplifier of the regulator module.

2. The analog output stage of claim 1, wherein the input detected by the field device comprises a process variable.

3. The analog output stage of claim 1, wherein the switching module is driven by a switching pulse width modulated signal generated by a processor of the field device.

4. The analog output stage of claim 1, wherein the first analog value is set by a reference pulse width modulated signal generated by a processor of the field device, and wherein the reference pulse width modulated signal is generated based on the input detected by the field device and a predefined analog output that corresponds to the input detected by the field device.

5. The analog output stage of claim 4, wherein the first analog value comprises a coarse component set by a first reference pulse width modulated signal generated by the processor of the field device and a fine component set by a second reference pulse width modulated signal generated by the processor, the fine component being a function of the coarse component, and wherein the switching module is configured to alternately apply to the regulator module, the coarse component, the fine component, and the second analog value.

6. The analog output stage of claim 5, wherein one or more of the first analog value and the second analog value are processed by one or more processing modules, before being applied to the regulator module, the processing modules comprising a filter and an amplifier.

7. The analog output stage of claim 4, wherein one or more of the first analog value and the second analog value are processed by one or more processing modules, before being applied to the regulator module, the processing modules comprising a filter and an amplifier.

8. The analog output stage of claim 1, wherein the first analog value comprises a coarse component set by a first reference pulse width modulated signal generated by a processor of the field device and a fine component set by a second reference pulse width modulated signal generated by the processor, the fine component being a function of the coarse component, and wherein the switching module is configured to alternately apply to the regulator module, the coarse component, the fine component, and the second analog value.

9. The analog output stage of claim 8, wherein one or more of the first analog value and the second analog value are processed by one or more processing modules, before being applied to the regulator module, the processing modules comprising a filter and an amplifier.

10. The analog output stage of claim 1, wherein one or more of the first analog value and the second analog value are processed by one or more processing modules, before being applied to the regulator module, the processing modules comprising a filter and an amplifier.

11. A method of regulating an analog output of a field device employed in process automation based on an input detected by the field device, the method comprising:

providing the field device comprising an analog output stage communicatively coupled to a processor of the field device, the analog output stage comprising a regulator module and a switching module;

obtaining, by the processor, the input detected by the field device, wherein the input comprises a process variable;

generating, by the processor, a reference pulse width modulated signal configured to output a first analog value based on the input detected by the field device and a predefined analog output that corresponds to the input detected by the field device;

detecting, by the processor, the analog output;

alternately providing to the regulator module the first analog value and a second analog value by the switching module, wherein the switching module is driven by a switching pulse width modulated signal generated by the processor, and wherein the second analog value is associated with the detected analog output;

integrating, by the regulator module, one or more of the first analog value and the second analog value from the switching module, wherein an integrator of the regulator module is configured to smoothen an output from the switching module, which is applied to an input of an operational amplifier of the regulator module;

generating, by the regulator module, a differential analog output based on the first analog value and the second analog value; and regulating, by the regulator module, the analog output of the field device based on the differential analog output.

12. The method of claim 11, further comprising:

processing one or more of the first analog value and the second analog value, by one or more processing modules of the analog output stage, before being applied to the regulator module, wherein the processing modules comprise a filter and an amplifier.

* * * * *